US011872434B2

(12) United States Patent
Moyer

(10) Patent No.: US 11,872,434 B2
(45) Date of Patent: Jan. 16, 2024

(54) EXERCISE MACHINE WITH TORSION BAR RESISTANCE UNIT

(71) Applicant: Erik J Moyer, Montoursville, PA (US)

(72) Inventor: Erik J Moyer, Montoursville, PA (US)

( * ) Notice: Subject to any disclaimer, the term of this patent is extended or adjusted under 35 U.S.C. 154(b) by 141 days.

(21) Appl. No.: 17/449,963

(22) Filed: Oct. 5, 2021

(65) Prior Publication Data

US 2022/0111241 A1 Apr. 14, 2022

Related U.S. Application Data

(60) Provisional application No. 63/091,634, filed on Oct. 14, 2020.

(51) Int. Cl.
*A63B 21/045* (2006.01)
*A63B 21/00* (2006.01)

(52) U.S. Cl.
CPC .... *A63B 21/0455* (2013.01); *A63B 21/00069* (2013.01)

(58) Field of Classification Search
CPC ..... A63B 23/0429; A63B 23/0405; A63B 23/03525; A63B 21/159; A63B 21/0632; A63B 21/0628; A63B 2208/0238; A63B 2225/30; A63B 21/0455; A63B 21/00069; A63B 2209/00; A63B 21/154
See application file for complete search history.

(56) References Cited

U.S. PATENT DOCUMENTS 3,917,262 A * 11/1975 Salkeld ..... A63B 23/0429 482/137
3,982,757 A * 9/1976 McDonnell ..... A63B 23/129 73/379.08
4,343,465 A * 8/1982 Allen ..... A63B 23/129 482/905
8,002,677 B2 * 8/2011 Dibble ..... A63B 21/4047 482/92
2016/0151659 A1 * 6/2016 Arnold ..... A63B 22/0664 482/52

* cited by examiner

*Primary Examiner* — Andrew S Lo
*Assistant Examiner* — Andrew M Kobylarz
(74) *Attorney, Agent, or Firm* — Matthew J Patterson

(57) ABSTRACT

A torsion bar resistance unit and a variable resistance unit system having at least one selectably engageable torsion bar is disclosed. A resistance training machine having a plurality of selectably engageable torsion bars coupled to a lever is disclosed wherein a rotational resistance load is based on which of the plurality of torsion bars are rotatably locked and the force applied to the lever. Also disclosed is a user interface that allows a user to selectively engage any of the plurality of torsion bars, output the total resistance load and the translation distance on an output screen.

20 Claims, 6 Drawing Sheets

EXERCISE MACHINE WITH TORSION BAR RESISTANCE UNIT

CROSS REFERENCE TO RELATED APPLICATIONS

This application claims the benefit of U.S. Provisional Patent Application Ser. No. 63/091,634 having a filing date of 14 Oct. 2020. The disclosure of the application above is incorporated herein by reference in its entirety.

BACKGROUND OF THE INVENTION

Field of the Invention

The present invention relates generally to the field of resistance units for exercise machines and more specifically it relates to a resistance unit having at least one torsion bar for resistance and other embodiments having a plurality of selectively engageable torsion bars to provide a range of resistances.

Description of the Related Art

It has been a long established practice to use free weights for training. Various types of resistance units are used in exercise machines to simulate the lifting of free weights that use various means of resistance such as plates, coil springs, bands and the like. There are well known brands of machines such as Nautilus®, Bowflex® and Cybex® to name a few examples. While these prior art machines work well in some weightlifting regimens, they do have their shortcomings. One type of strength training known as static contraction training is difficult to accomplish with prior art resistance machines and free weights. Static contraction training is based on the idea of utilizing a low range of motion—the last few inches of a given motion—to maximize the amount of muscle fibers engaged while lifting as heavy a weight as possible. Static contraction training is unlike isometric exercises which involve a static hold of a weight (or resistance) but does not necessarily involve a high intensity in the amount of weight. There are many websites providing insight, instruction and guidance in the area of static contraction training such as https://www.bodybuilding.com/fun/sisco6.htm, https://www.precisiontraining.com, and https://www.muscleandfitness.com/routine/workouts/workout-routines/static-contractions-grow-standing-still/.

With respect to static contraction training, some resistance training units of the prior art have the ability to limit the range of motion for certain targeted training. However, many of the resistance training units lack the high resistance capacity necessary for static contraction training. In prior art resistance training machines that utilize plates of weights the cost of large amounts of weight becomes cost prohibitive, time consuming to load certain plates and make such units difficult to move, taking up a lot of floor space and potentially requiring substantial structural support making them unsuitable for residential settings.

Another drawback of prior art resistance training machines, is that they provide little performance feedback to the user, provide little or no ability to automatically measure, track time, and save and access information.

In view of the foregoing, there is a need for an improved resistance unit for use in an exercise machine.

SUMMARY OF THE INVENTION

One general aspect includes a resistance unit. The resistance unit also includes a frame, a lever rotatably connected to the frame and rotatable about a first axis, and at least one torsion bar mounted to the frame parallel to the first axis and coupled to the lever and configured to produce a torsional resistance when a force is applied to the lever.

Implementations may include one or more of the following features. The resistance unit may include the frame may include a base plate, a right hand support positioned on a first end of the base plate, a left hand support positioned on a second end of the base plate, a right hand lever support positioned on a right hand portion of the base plate, and a left hand lever support positioned on a left hand portion of the base plate, the at least one torsion bar may include at least one right hand torsion bar positioned between the right hand support and the right hand lever support and at least one left hand torsion bar positioned between the left hand support and the left hand lever support, and the lever positioned between the right hand lever support and the left hand lever support. The resistance unit may include a lever shaft rotatably connected to the right hand lever support and the left hand lever support and rigidly coupled to the lever, a plurality of actuators, the at least one right hand torsion bar is coupled to an actuator of the plurality of actuators having a lock position and an unlock position configured to selectively rotatably lock the at least one right hand torsion bar to the right hand support and to the lever shaft in the lock position, and the at least one left hand torsion bar is coupled to an actuator of the plurality of actuators having a lock position and an unlock position and is configured to selectively rotatably lock and the at least one left hand torsion bar to the left hand support and to the lever shaft in the lock position. The torsional resistance is produced when any of the of the plurality of actuators of the at least one torsion bar is in the lock position when the force is applied to the lever. The resistance unit may include a right hand driving gear coupled to a right hand end of the lever shaft, a left hand driving gear coupled to a left hand end of the lever shaft and a driven gear coupled to each of the at least one right hand torsion bar and in meshing arrangement with the right hand driving gear, and a driven gear coupled to each of the at least one left hand torsion bar and in meshing arrangement with the left hand driving gear. The actuator of the at least one right hand torsion bar is coupled to the driven gear and the actuator of the at least one left hand torsion bar is coupled the driven gear. The actuator coupled to the at least one right hand torsion bar and is positioned in any of the right hand support and the left hand lever support and the actuator coupled to the at least one left hand torsion bar is positioned in any of the left hand support and the left hand lever support. The resistance unit any of the at least one right hand torsion bar and the at least one left hand torsion bar are configured to produce a different torsional resistance. The resistance unit may include at least one strain measurement device configured to measure a total resistance load and a sensor to measure a translation distance of the lever. The resistance unit may include a power source, and a user interface having an output screen and coupled to the power source and the plurality of actuators and configured to allow a user to selectively position any of the plurality of actuators in the lock position, and output the total resistance load and the translation distance on the output screen. The at least one torsion bar may include a torsion bar assembly may include a lever shaft may include of an elongated tube having a set of engagement holes distributed along a length and coupled to the lever, the torsion bar having a complementary set of respective engagement holes and rigidly positioned in the frame at a first end and rotatably positioned in the frame at a second and positioned at least partially within the lever shaft, and an actuation pin configured to selectively couple the lever shaft and the torsion bar when engaged in one of the set of engagement holes and the complementary set of respective engagement holes. Implementations of the described techniques may include hardware, a method or process, or computer software on a computer-accessible medium.

One general aspect includes a resistance training machine. The resistance training machine also includes a variable resistance training unit having at least one moveable member, variable resistance unit may include a frame, a lever rotatably coupled to the frame, a plurality of torsion bars selectively rotatably mounted to the frame and to the lever. The machine also includes the at least one moveable member coupled to the lever.

Implementations may include one or more of the following features. The resistance training machine may include a plurality of actuator assemblies having a lock position and an unlock position, where one of the plurality of actuator assemblies is coupled to each of the plurality of torsion bars and configured to selectively rotatably lock the plurality of torsion bars to the frame and to the lever in the lock position, where the plurality of torsion bars are adapted to apply a rotational resistance load to the lever when at least one of the plurality of actuator assemblies is in the lock position and when a force is applied to the lever, and where the rotational resistance load is based on which of the plurality of torsion bars are rotatably locked and the force applied to the lever. The at least one moveable member is configured to apply a force against the rotational resistance load when a force is applied to the at least one moveable member by a user. The at least one moveable member has a translation distance and where the translation distance is based on which of the plurality of torsion bars are rotatably locked and the force applied to the lever. Any of the plurality of torsion bars are configured to produce a different torsional resistance. The resistance training machine may include at least one strain measurement device configured to measure a total resistance load and a sensor to measure a translation distance of the moveable member. The resistance training machine may include a power source, a user interface having an output screen and coupled to the power source and the plurality of actuators and configured to allow a user to selectively position any of the plurality of actuators in the lock position, and output a total resistance load and the translation distance on the output screen. The resistance training machine may include the user interface configured to allow a user to selectively position any of the plurality of actuators in the unlock position. The moveable member is coupled to the lever by a system may include of a cable and a plurality of pulleys. Implementations of the described techniques may include hardware, a method or process, or computer software on a computer-accessible medium.

BRIEF DESCRIPTION OF THE DRAWINGS

So that the manner in which the above-recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In the following detailed description of the embodiments, reference is made to the accompanying drawings, which form a part hereof, and within which are shown by way of illustration specific embodiments by which the examples described herein may be practiced. It is to be understood that other embodiments may be utilized and structural changes may be made without departing from the scope of the disclosure.

Figure 1:
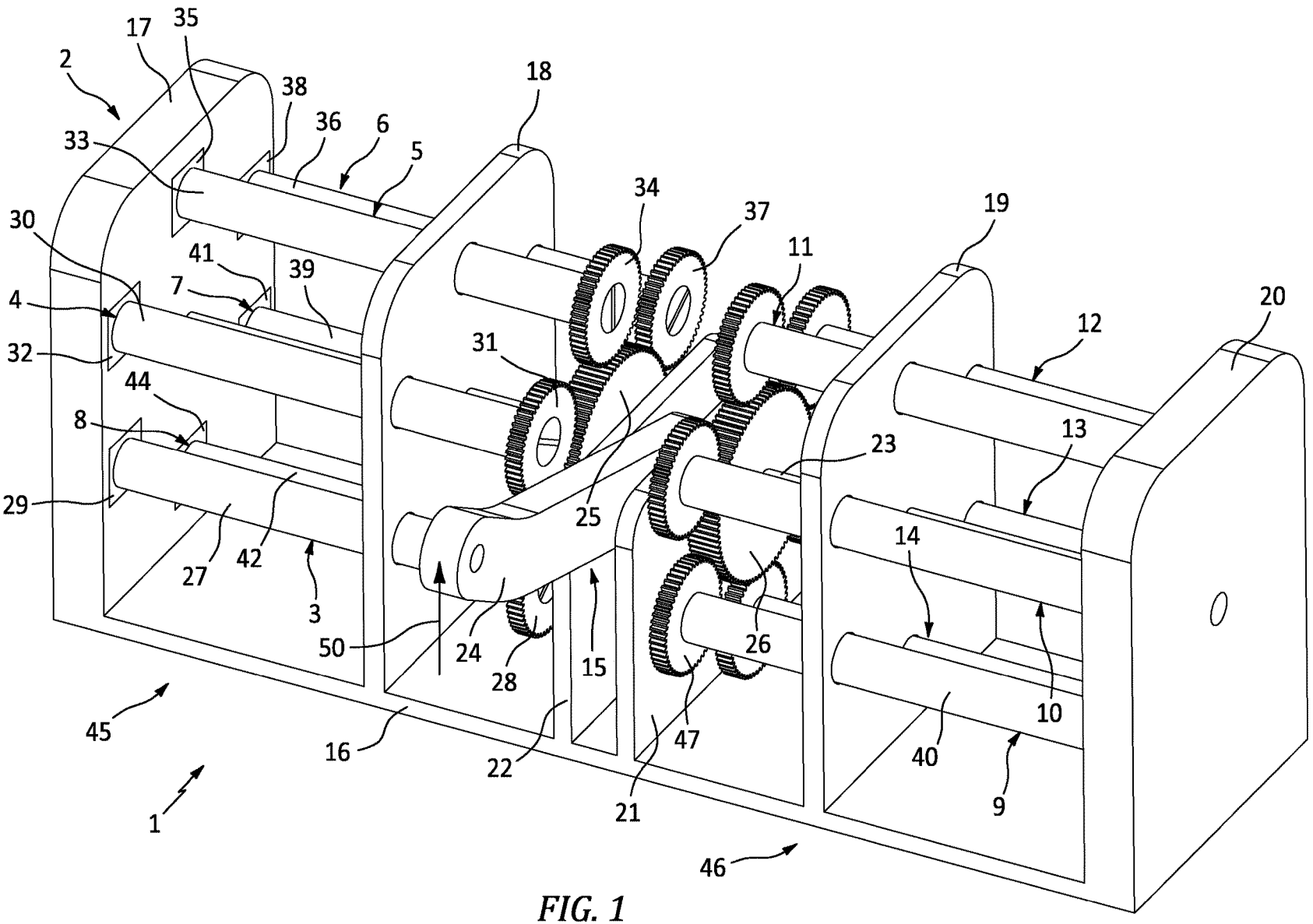
FIG. 1 is an isometric view of a torsion bar resistance system in accordance with the present disclosure.

Referring to FIG. 1, there is shown an embodiment of a variable resistance unit in the form of a torsion bar resistance unit 1 of the present disclosure that includes a frame 2, a plurality of torsion bar assemblies 3, 4, 5, 6, 7, 8, 9, 10, 11, 12, 13, 14 and lever assembly 15. Frame 2 includes base plate 16, left end support 17, left mid support 18, right mid support 19, right end support 20, left lever support 22 and right lever support 21. Frame 2 can comprise any suitable material and is shown as a contiguous piece with base plate 16, left end support 17, left mid support 18, right mid support 19, right end support 20, left lever support 21 and right lever support 22; however it can be comprised of separate pieces and joined in any suitable manner such as welding, brazing, bolting, co-molding and the like. Lever assembly 15 is comprised of lever shaft 23 that is fixedly attached to lever 24 and rotatably captured within left mid support 18, right mid support 18, right end support 20, left lever support 21 and right lever support 22. Lever assembly 15 further includes left driving gear 25 and right driving gear 26 fixedly attached to lever shaft 23. In the embodiment shown, the plurality of torsion bar assemblies 3, 4, 5, 6, 7, 8, 9, 10, 11, 12, 13, 14 are substantially similar in terms of parts and function and can differ in materials and geometries to produce different torsional stiffness and ranges of motion as will be described in more detail herein after. Torsion bar assembly 3 includes torsion bar 27, driven gear 28 and an actuator assembly in the form of clutch assembly 29. Driven gear 28 is fixedly attached to torsion bar 27 and is in fixed meshing engagement with left driving gear 25. Torsion bar 27 is rotationally captured within left mid support 18 and within clutch assembly 29 which clutch assembly is fixedly positioned within left end support 17. As will be described in more detail herein after, torsion bar 27 is rotationally fixed within clutch assembly 29 when the clutch assembly is locked (engaged) and is free to rotate when the clutch assembly is unlocked (disengaged). Torsion bar assembly 4 includes torsion bar 30, driven gear 31 and clutch assembly 32. Driven gear 31 is fixedly attached to torsion bar 30 and is in fixed meshing engagement with left driving gear 25. Torsion bar 30 is rotationally captured within left mid support 18 and within clutch assembly 32 which clutch assembly is fixedly positioned within left end support 17. Torsion bar 30 is rotationally fixed within clutch assembly 32 when the clutch assembly is engaged and is free to rotate when the clutch assembly is disengaged. Torsion bar assembly 5 includes torsion bar 33, driven gear 34 and clutch assembly 35. Driven gear 34 is fixedly attached to torsion bar 33 and is in fixed meshing engagement with left driving gear 25. Torsion bar 33 is rotationally captured within left mid support 18 and within clutch assembly 35 which clutch assembly is fixedly positioned within left end support 17. Torsion bar 33 is rotationally fixed within clutch assembly 35 when the clutch assembly is engaged and is free to rotate when the clutch assembly is disengaged. Torsion bar assembly 6 includes torsion bar 36, driven gear 37 and clutch assembly 38. Driven gear 37 is fixedly attached to torsion bar 36 and is in fixed meshing engagement with left driving gear 25. Torsion bar 36 is rotationally captured within left mid support 18 and within clutch assembly 38 which clutch assembly is fixedly positioned within left end support 17. Torsion bar 36 is rotationally fixed within clutch assembly 38 when the clutch assembly is engaged and is free to rotate when the clutch assembly is disengaged. Torsion bar assembly 7 includes torsion bar 39, driven gear (not shown) and clutch assembly 41. The driven gear is fixedly attached to torsion bar 39 and is in fixed meshing engagement with left driving gear 25. Torsion bar 39 is rotationally captured within left mid support 18 and within clutch assembly 41 which clutch assembly is fixedly positioned within left end support 17. Torsion bar 39 is rotationally fixed within clutch assembly 41 when the clutch assembly is engaged and is free to rotate when the clutch assembly is disengaged. Torsion bar assembly 8 includes torsion bar 42, driven gear (not shown) and clutch assembly 44. The driven gear 43 is fixedly attached to torsion bar 42 and is in fixed meshing engagement with left driving gear 25. Torsion bar 42 is rotationally captured within left mid support 18 and within clutch assembly 44 which clutch assembly is fixedly positioned within left end support 17. Torsion bar 42 is rotationally fixed within clutch assembly 44 when the clutch assembly is engaged and is free to rotate when the clutch assembly is disengaged. The plurality of torsion bar assemblies 3, 4, 5, 6, 7, 8 comprise left hand resistance assembly 45 and the plurality of torsion bar assemblies 9, 10, 11, 12, 13, 14 comprise right hand resistance assembly 46. It should be appreciated by those skilled in the art that the various torsion bars of torsion bar assemblies 9, 10, 11, 12, 13, 14 are parallel to each other along their axes and are further parallel to the axis of lever shaft 23. For the sake of brevity, but without sacrificing completeness and enablement, the plurality of torsion bar assemblies 9, 10, 11, 12, 13, 14 of right-hand resistance assembly 46 all include a torsion bar, a driven gear and a clutch assembly as described herein above. Although the left hand resistance unit 45 and the right hand resistance unit 46 comprise six torsion bar assemblies each, torsion bar resistance unit 1 can have more or fewer torsion bar assemblies without departing from the scope of the present disclosure (See FIG. 4 for example).

Still referring to FIG. 1, actuators in the form of clutch assemblies 29, 32, 35, 38, 41, 44 and similar clutch assemblies (not shown) of right-hand resistance assembly may comprise any known type of clutch configured to selectively couple and uncouple the torsion rods to the driving gear and in the embodiment shown they lock the rotation of the torsion rods relative to left end support 17 and right end support 20 respectively in an engaged mode. One such known clutch is an electrically powered clutch having part number PB-500 and is commercially available from Warner Electric®. In such a configuration, the clutch assemblies include an internal spline that couples with external splines on the torsion bars and are electrically connected to a power supply. In other embodiments the clutch assemblies can be coupled to the driven gears (not shown) and configured to selectively rotatably lock and unlock the torsion rods to the driving gears in a respective lock position and unlock position. As will be disclosed in more detail herein after, the clutch assemblies can include user activated controls electrically coupled to the power supply such that when any particular clutch assembly is selected by the user that particular torsion rod is rotationally fixed with its respective frame assembly. It should be appreciated by those skilled in the art that when any particular torsion rod is rotationally fixed with its respective frame assembly then that particular torsion rod will provide resistance from movement when a force 50 is applied at lever arm 24.

In the embodiment shown, the torsion bar assemblies 3-14 having been herein above described as similar in terms of elements and arrangements, the resistance producing capability of each torsion bar assembly can be described with reference to any single torsion bar assembly. In operation, and using torsion bar assembly 3 as an example, with clutch assembly 29 disengaged, when a force is applied lever arm 24 left driving gear 25 will produce a rotation in driven gear 28 and torsion bar 27 will be caused to rotate relative to frame 2. With clutch assembly 29 in an engaged state, left driving gear 25 will produce a torque in driven gear 28 and torsion bar 27 will produce an internal resisting torque causing the torsion bar to twist in the direction of the torque and producing a torsional stress in the torsion bar and transferring that torsional stress into a rotational resistance load in lever shaft 23. The amount of internal resisting torque is roughly equal to the external force applied at lever 24 and the gear ratio between left driving gear 25 and driven gear 28.

Figure 2:
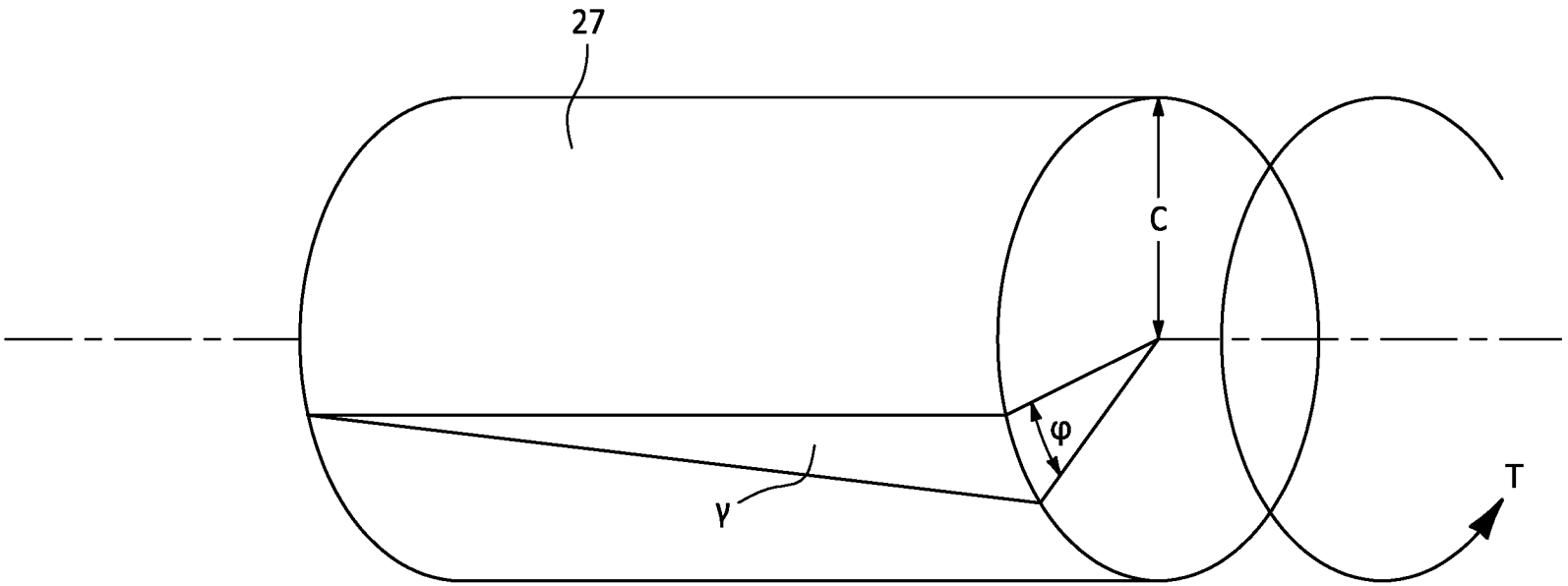
FIG. 2 is a static force diagram of a torsion bar resistance system in accordance with the present disclosure.

Referring now to FIG. 2, there is shown a portion of torsion bar 27 wherein the torsion bar is solid and having a radius "c" and a diameter d equal to 2c. The torque applied to torsion bar 3 as a result of a force applied to lever 24 is shown as "T" and produces an angle of twist φ. For a solid circular torsion bar 27 comprised of an elastic material, the behavior of the torsion rod will follow Hooke's law. To determine the internal resisting torque and angle of twist one can start by determining the maximum shear stress $\tau_{max}$ which occurs in torsion bar 27. According to Hooke's law and the parameters disclosed above, at any point r inside torsion bar 27, the shear stress is $\tau_r = r/c\ \tau_{max}$. With the applied torque T, the maximum shear stress is governed by the following relationship:

$$\tau_{max} = Tc/J \quad \text{(Equation 1)}$$

where J is polar moment of inertia of the cross-sectional area of torsion bar 27 and is governed by the following relationship:

$$J = \pi/32(d)^4 \quad \text{(Equation 2)}$$

Referring still to FIG. 2, the angle of twist φ of torsion bar 27 acted upon by a torque T at driven gear 28 is shown. As one skilled in the art can appreciate, the shear angle γ is governed by the following relationship:

$$\gamma = \tau/G \quad \text{(Equation 4)}$$

where G is the shear modulus of the material that comprises torsion bar 27. For torsion bar 27 of radius c, the following relationship is arrived at:

$$\varphi c = \gamma L \quad \text{(Equation 5)}$$

where L is the length of torsion bar 27 from driven gear 28 to clutch assembly 29. It should be noted that because torsion bar 27 is captured within left end support 17 and left mid support 18 the cross sections of the torsion bar remain in plane after the torque is applied. Given Equation 1, the angle of twist φ is governed by the following relationship:

$$\varphi = TL/GJ \quad \text{(Equation 6).}$$

In a continuance of the foregoing example, and in an embodiment of torsion bar resistance unit 1 wherein lever 24 has a length of 12 inches and left driving gear 25 is twice as large in diameter as driven gear 28, a 100 pound force applied to lever 24 in upward direction 50 would produce a torque T of 1200 inch-pounds in torsion bar 27. In this particular example, torsion bar 27 is comprised of a solid structural steel bar having a shear modulus G=11.5 psi and a diameter of 1 inch. From Equation 2, the polar moment of inertia of the cross-sectional area of torsion bar 27 is approximately 1106 $in^4$. Using Equation 6, the 100 pound force applied to lever 24 produces a twist angle φ of approximately 13° at driven gear 28. Given the 2:1 gear ratio between left driving gear 25 and driven gear 28, the driving gear rotates only half as much as the driven gear and using the geometric relationships disclosed above lever 24 travels about 1.4 inches. In this particular example only clutch assembly 29 is engaged and all of the other plurality of clutch assemblies are in the disengaged condition and their respective torsion bars rotate freely therein producing negligible resistance to the force applied at lever 24.

In another example wherein a second clutch assembly of a torsion bar assembly is selectively positioned in the engaged condition, say torsion bar assembly 9 the resistance force is shared by both torsion bar 27 and torsion bar 40. If the mechanical and physical properties of torsion bar 40 where substantially equal to torsion bar 27, the twist angle φ at driven gears 28, 47 would be approximately 6.5° and lever 24 travels about 0.7 inches, or half as much. As in the example above, all of the other plurality of clutch assemblies are in the disengaged condition and their respective torsion bars rotate freely therein producing negligible resistance to the force applied at lever 24. It should be appreciated by those skilled in the art that in a torsion bar resistance unit 1 of the present disclosure, the resistance force and the translation distance of lever 24 for a given load can be selectively controlled by a user. For any torsion rod selection, the resistance goes up as the translation distance of lever 24 increases and the lever translation distance goes down as the number of torsion rod assemblies is selectively increased. Because very high loads can be produced with small translation distances of lever 24, torsion bar resistance unit 1 of the present disclosure can be inventively adapted to the type of isometric resistance training disclosed herein above. In certain embodiments, strain measurement devices can be coupled to torsion bar assemblies 3-14 and lever assembly 15 to provide an output signal to a user related to the total resistance load achieved by the user. Other such sensors configured to measure the resistance load and translation distance achieved are contemplated by the present disclosure.

Figure 3:
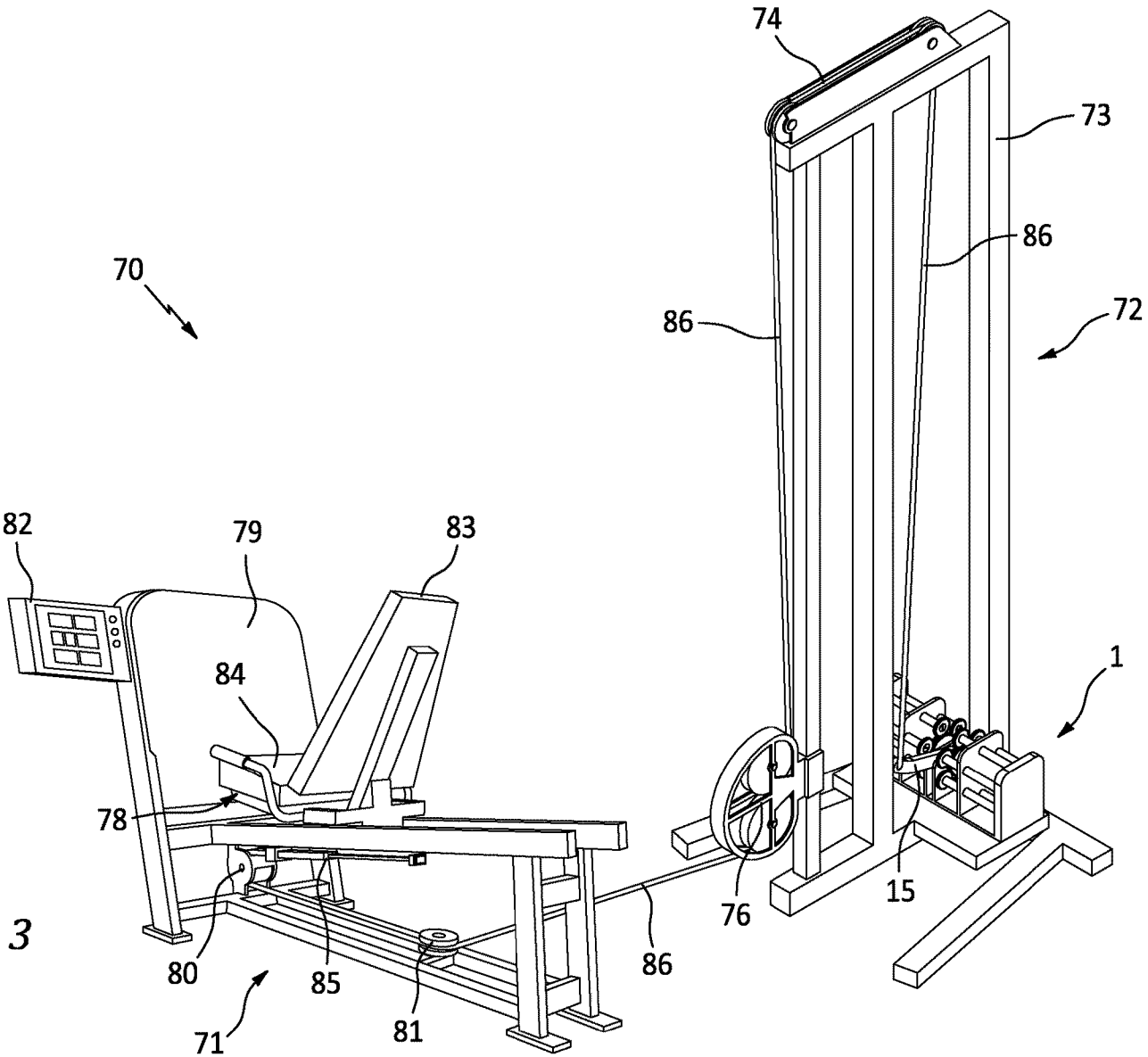
FIG. 3 is a resistance training machine including a torsion bar resistance system in accordance with the present disclosure.

Referring now to FIG. 3, there is shown a resistance training machine 70 having a resistance training unit in the form of a seated leg press machine. Although shown in this example as a seated leg press machine, embodiments employing the novel aspects of the present disclosure are not so limited. Resistance training machine 70 includes seated leg press assembly 71 and resistance assembly 72 mechanically coupled thereto. Resistance assembly 72 includes frame 73, torsion bar resistance unit 1 fixedly attached to the frame, horizontal pulley assembly 74 and vertical pulley assembly 76. Seated leg press assembly 71 includes seat frame 77, a moveable member such as seat assembly 78 slidably attached to the frame, foot plate 79, first turn pulley 80, second turn pulley 81 and optional user interface 82. Seat assembly 78 includes seat back 83, seat 84 and a cable attachment 85 adjustably mounted to the bottom of the seat. Resistance machine 70 also includes cable 86 attached to cable attachment 85 and routed through first turn pulley 80, second turn pulley 81, vertical pulley assembly 76, horizontal pulley assembly 74 and is further attached to lever assembly 15 of torsion bar resistance unit 1. Resistance training machine 70 functions such that seat assembly 78 slides toward and away from foot plate 79 and relative to seat frame 77 when a force is applied therebetween by a user and in so doing cable 86 translates though the various pulleys 80, 81, 76 and 74 to actuate lever assembly 15 and torsion bar resistance unit 1 thereby to produce resistance to the user as disclosed herein above.

With continued reference to FIG. 3, in operation a user positions seat assembly 78 in an initial position to properly position the user relative to the foot plate 79 and cable attachment 85 is fixed to the seat assembly at the initial position such that there is no slack in the cable. A user then manipulates optional user interface 82 coupled to a power source, which user interface can include an output screen and input features, to selectively engage the desired number of torsion bar assemblies 3-14 (FIG. 1) to a desired predetermined resistance level and translation distance of seat assembly 78 relative to foot plate 79. The user is then positioned within seat assembly 78 with the user's back against seat back 83 and at least one of the user's feet positioned on foot plate 79. The user then exerts a force against foot plate 79 and the data is displayed and can be recorded on optional user interface 82. The user can then repeat the same exercise or use the optional user interface to selectively change the number and type of the desired torsion bar assemblies 3-14 to engage for subsequent exercise(s). Optional user interface 82 can be electrically connected to torsion bar resistance unit 1 to send signals to engage and disengage clutch assemblies 29, 32, 35, 38, 41, 44 and the clutch assemblies of right hand resistance unit 46 in accordance with the user's selection(s). It will be appreciated that resistance training machine 70 can take on many forms and can be comprised by retrofitting an existing training machine with a resistance unit 1 to produce a resistance training machine for various positions to provide for static contraction type exercise. One such prior art training machine that can be retrofitted with resistance unit is an FTS Glide machine offered by Precor® the details of which can be found at https://www.precor.com/en-us/commercial/strength/functional-training/fts-glide.

Optional user interface 82 can also be wirelessly connected to resistance unit 1 using known techniques such as Bluetooth®, WiFi and other near range connective technologies and adapted to display various parameters of resistance training machine 70. Optional user interface can be adapted to accept a user possessed memory device such as a memory stick or SD card and can further be adapted to interface with the user through cloud-based software, memory and protocols. In some embodiments, a user can control resistance unit 1 using a smart device such as a smart phone.

It should be further appreciated by those skilled in the art that the embodiment disclosed is merely an example of a torsion bar resistance unit 1 and that an almost unlimited number of embodiments exists. For instance, a torsion bar resistance unit of the present disclosure includes embodiments have more or fewer torsion rod assemblies, more or fewer driving gears and more levers, longer and shorter length torsion rods, clutches mounted in in the mid supports, among other iterations. In addition, the plurality of torsion bars can be comprised of the same, different or vastly different materials producing different internal torsion resistance, angle of twist and lever translation. Among the various materials are metals, rubbers, elastomers, composites and other suitable materials. Similarly, the plurality of torsion bars can be comprised of different diameters producing different internal torsion resistance, angle of twist and lever translation. In addition, the torsion bars can be comprised of a different cross section shape (such as square, octagonal and the like) and can be hollow or partially hollow (FIGS. 4, 5) and thereby producing a different polar moment of inertia of the cross-sectional area of torsion bar which in turn produces different internal torsion resistance, angle of twist and lever translation for a given applied load. It should be noted that the example disclosed herein above is but one of many embodiments of an exercise machine using a torsion bar resistance unit 1 having a variable resistance and variable translation capability and can further be implemented in commercial applications as well as educational and home settings. For example, the torsion bars can be fixedly attached to the side supports and the driven gears and include the clutch assemblies to selectively engage and disengage any of the plurality of torsion rods to increase or decrease the resistance. In addition, the force applied to lever assembly 15 can be applied in a direction opposite to direction 50 and produce similar results.

Figure 4:
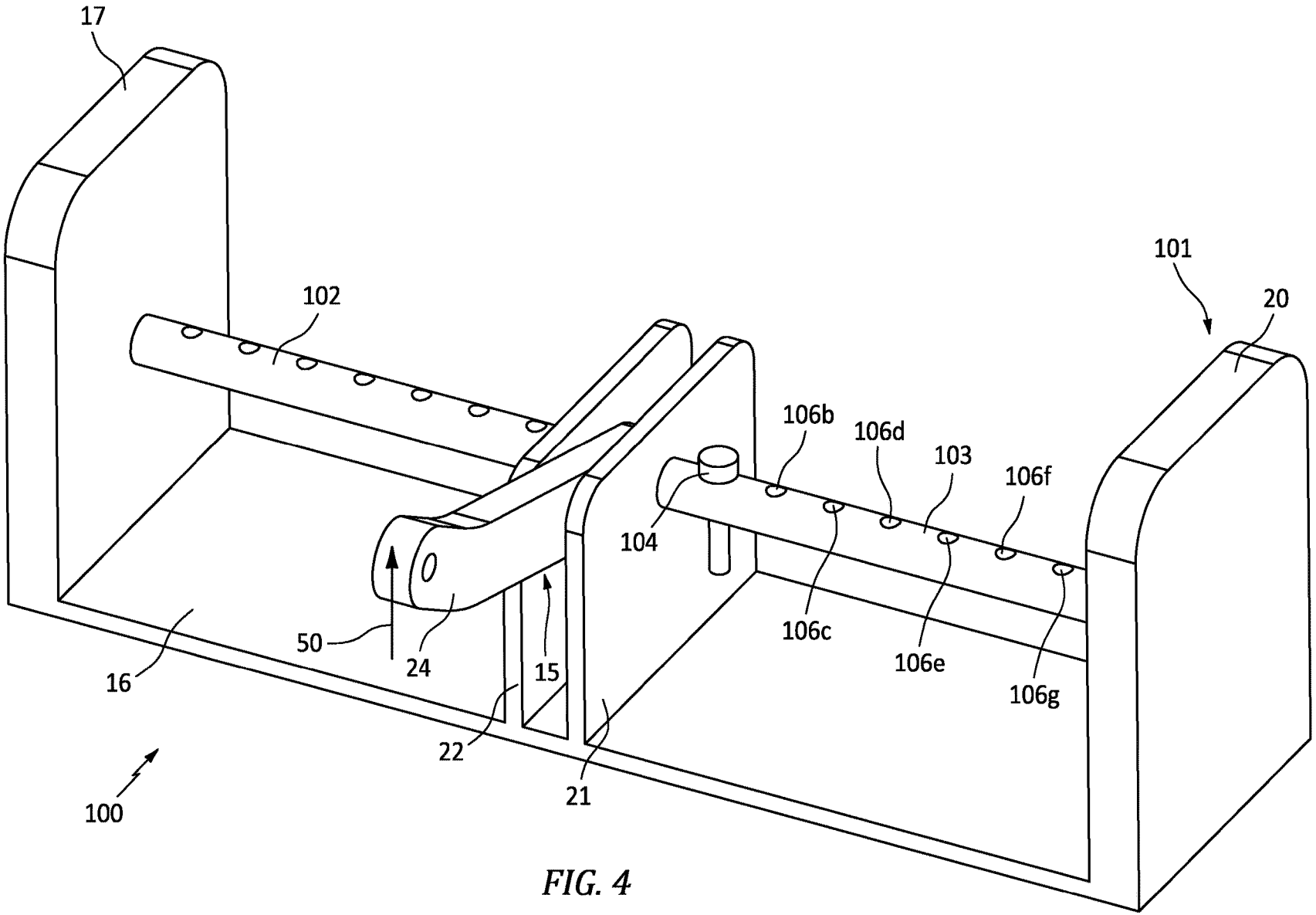
FIG. 4 is an isometric view of a torsion bar resistance system in accordance with the present disclosure.
Figure 5:
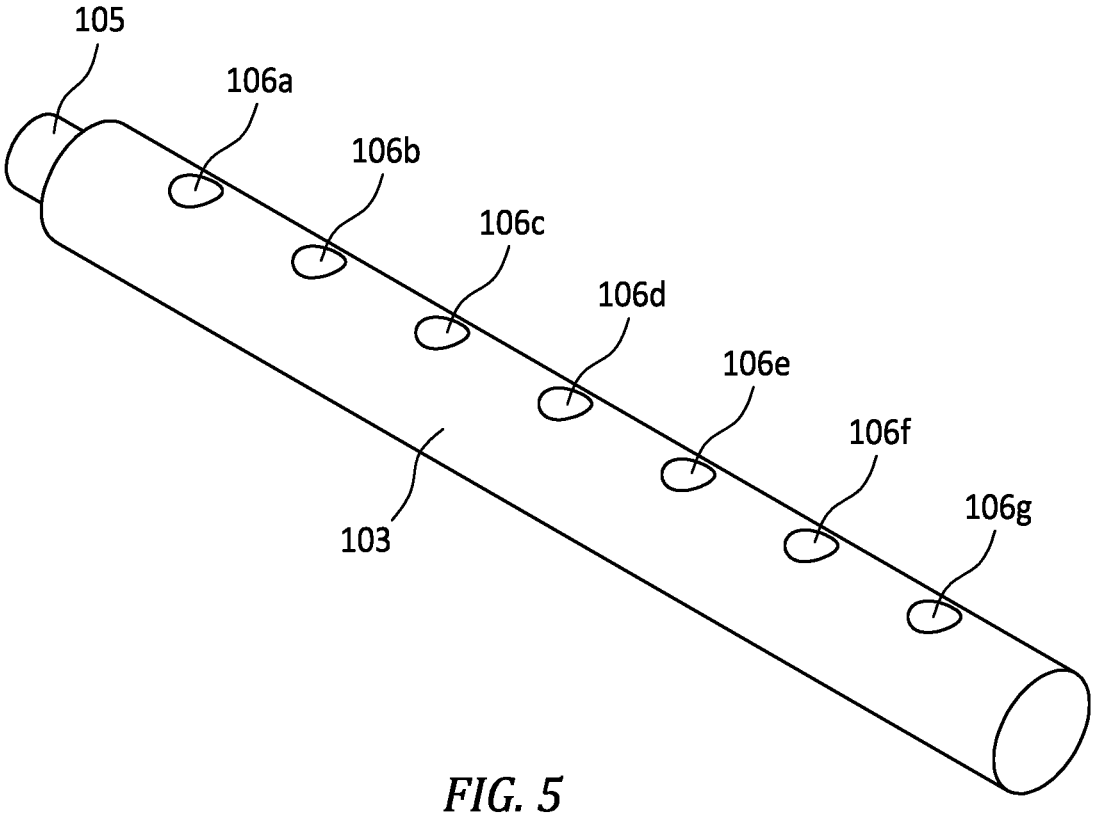
FIG. 5 is an isometric view of a torsion bar assembly of a torsion bar resistance system of FIG. 4 in accordance with the present disclosure.

Referring to FIGS. 4 and 5, there is shown an embodiment of a variable resistance unit in the form of a torsion bar resistance unit 100 of the present disclosure that includes a frame 101, a plurality of torsion bar assemblies 102, 103 and lever assembly 15. Torsion bar assemblies 102, 103 comprise elongated tubes in this embodiment. Frame 101 includes base plate 16, left end support 17, right end support 20, left lever support 21 and right lever support 22. Frame 101 can comprise any material suitable material and is shown as a contiguous piece with base plate 16, left end support 17, left mid support 18, left lever support 21 and right lever support 22, however it can be comprised of separate pieces and joined in any suitable manner such as welding, brazing, bolting, co-molding and the like. Lever assembly 15 is comprised of a lever shaft 105 that is fixedly attached to lever 24 and positioned within torsion bar assemblies 102, 103. In the embodiment shown the plurality of torsion bar assemblies 102, 103 are partially hollow cylinders and are substantially similar in terms of parts and function and can differ in materials and geometries to produce different results in terms of different torsional resistance as described herein above. Torsion bar assembly 102 is rotatably positioned within left lever support 22 and fixedly positioned within left end support 17. Torsion bar assembly 103 is rotatably positioned within right hand lever support 21 and is fixedly attached to right end support 20. Torsion bar 103 includes engagement holes **106*a*-106*g* arranged along its length and lever shaft 105 has a complementary set of respective engagement holes (not shown). As will be described in more detail herein after, torsion bar assembly 103 is rotationally fixed to lever shaft 105 by actuation pin 104 inserted through one of the engagement holes 106*a*-106*g* in a locked position (engaged). Lever shaft 105 is free to rotate within torsion bar assembly 103 when the actuation pin is removed to produce an unlocked position (disengaged). Similarly, torsion bar 102 includes a set of engagement holes arranged along its length and is rotationally fixed to lever shaft 105 by an actuation pin (not shown) in a locked position (engaged). Lever shaft 105 is free to rotate within torsion bar assembly 102 when the actuation pin is removed to produce an unlocked position (disengaged). Variable resistance unit 100 functions similarly to that described herein above with reference to torsion bar resistance unit 1 but comprises just two torsion bars. In use, the user selects the amount of resistance desired by selecting either torsion bar assembly 102 or torsion bar assembly 103 or both. The user can also vary the resistance by choosing which of the engagement holes within which to insert actuation pin 104. It should be appreciated by those skilled in the art that the position of actuation pin 104 effectively changes the length L (Equation 6) and that a commensurate increase in torque T would be necessary to produce the same angle of twist $\varphi$. With this in mind, the least amount of resistance is obtained by inserting pin 104 in engagement hole 106*a* of torsion bar assembly 103 (or torsion bar assembly 102) and the most amount of resistance is achieved by selecting engagement hole 106*g* in both torsion bar assembly 102 and torsion bar assembly 103. In other embodiments torsion bar 102** can be comprised of a different geometric cross section (square, hexagonal, etc.). In such embodiments a mating socket (not shown) having a matching geometrical opening can be used to fix the rotation of the torsion bar.

Figure 6:
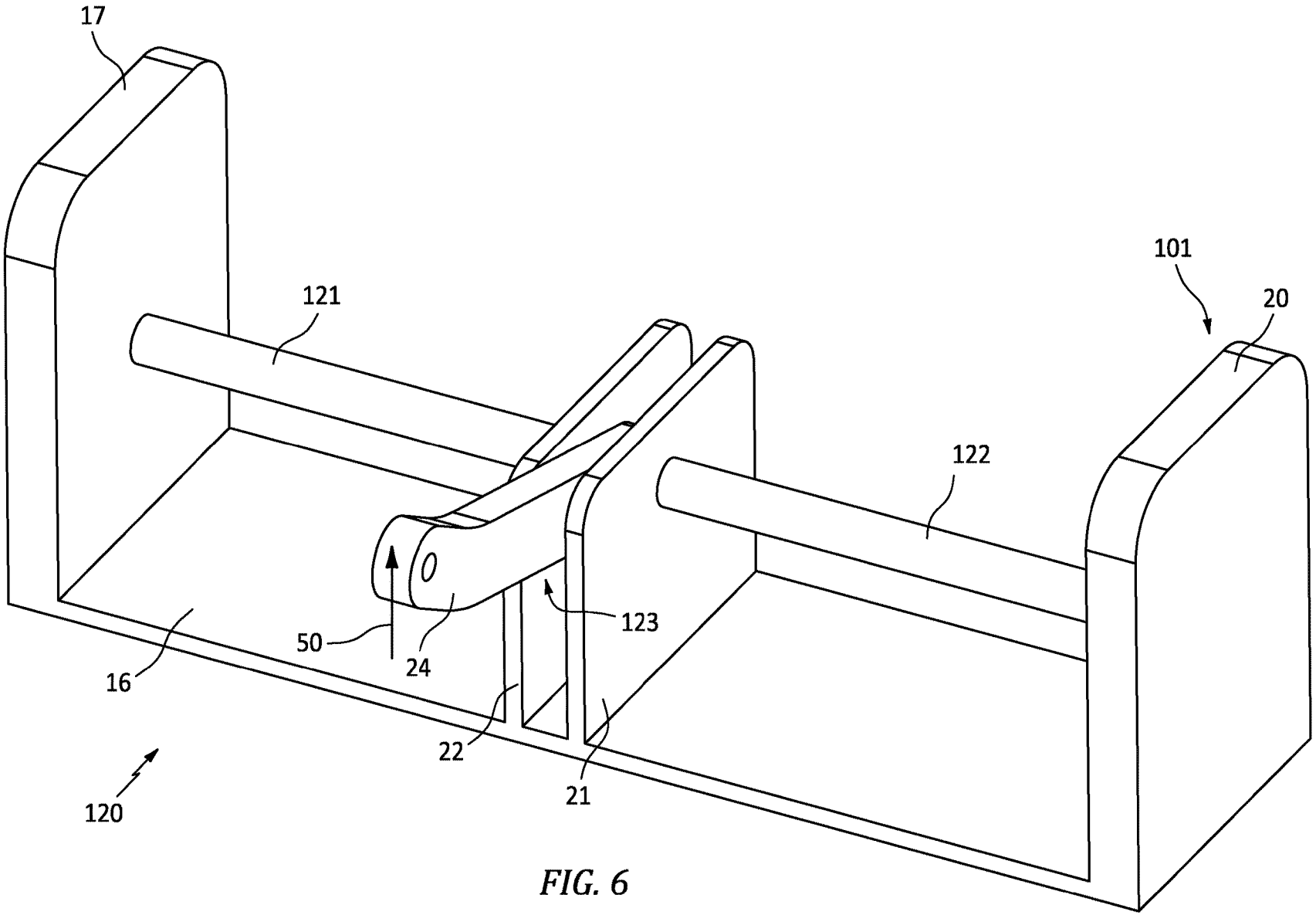
FIG. 6 is an isometric view of a torsion bar resistance system in accordance with the present disclosure.

As part of the present disclosure, alternative embodiments to a variable resistance unit of torsion bar resistance unit 1 (FIG. 1) and torsion bar resistance unit 100 (FIG. 4) include a fixed or semi-fixed torsion bar resistance unit best shown by way of example with reference to FIG. 6. Torsion bar resistance unit 120 of the present disclosure includes a frame 101, a plurality of torsion bars 121, 122 and lever assembly 15. Frame 101 includes base plate 16, left end support 17, right end support 20, left lever support 21 and right lever support 22. Frame 101 can comprise any material suitable material and is shown as a contiguous piece with base plate 16, left end support 17, left mid support 18, left lever support 21 and right lever support 22, however it can be comprised of separate pieces and joined in any suitable manner such as welding, brazing, bolting, co-molding and the like. Torsion bars 121, 122 are fixed to lever assembly 15 and in some embodiments, they comprise a single torsion bar. In the embodiment shown the plurality of torsion bars 121, 122 can comprise solid, hollow and partially hollow cylinders (as well as other geometric cross-sectional shapes) and are substantially similar in terms of parts and function and can differ in materials and geometries to produce different results as described herein above. Torsion bar 121 is rotatably positioned within left lever support 22 and fixedly positioned within left end support 17. Torsion bar 122 is rotatably positioned within right hand lever support 21 and is fixedly attached to right end support 20. Resistance unit 120 functions similarly to that described herein above with reference to torsion bar resistance unit 100 but comprises two fixed torsion bars without pin engagement adjustability. It is contemplated by the present disclosure that torsion bars 121, 122 can include torsion bars of differing resistance producing capability and that they may be able to be removably exchanged from resistance unit 120 with such torsion bars of differing resistance producing capability depending on a user's preference. In other embodiments of the present disclosure a resistance unit is contemplated that would include just a single torsion bar, such as either 121 or 122, to reduce the foot print and complexity of the resistance unit (not shown). It should be noted that the torsion bars in the various resistance units of the present disclosure can be removed from the unit and replaced with different torsion bars having different resistances based on size, shape material, etc. without departing from the scope of the present disclosure.

All of the methods disclosed and claimed herein can be made and executed without undue experimentation in light of the present disclosure. While the apparatus and methods of this invention have been described in terms of preferred embodiments, it will be apparent to those of skill in the art that variations may be applied to the methods and in the steps or in the sequence of steps of the method described herein without departing from the concept, spirit and scope of the invention. In addition, modifications may be made to the disclosed apparatus, and components may be eliminated or substituted for the components described herein where the same or similar results would be achieved. All such similar substitutes and modifications apparent to those skilled in the art are deemed to be within the spirit, scope, and concept of the invention.

Although the invention(s) is/are described herein with reference to specific embodiments, various modifications and changes can be made without departing from the scope of the present invention(s), as presently set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated other The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

While the foregoing is directed to embodiments of the present invention, other and further embodiments of the invention may be devised without departing from the basic scope thereof, and the scope thereof is determined by the claims that follow.

What is claimed is:

1. A resistance unit, comprising:

a frame;

a lever rotatably connected to the frame and rotatable about a first axis; and at least one torsion bar mounted to the frame parallel to the first axis and coupled to the lever, and wherein an internal resisting torque is produced in the torsion bar to produce a rotational resistance load in the lever when a force is applied to the lever when the at least one torsion bar is rotatably locked to the frame.

2. The resistance unit of claim 1 further comprising:

the frame comprising:

a base plate;

a right hand support positioned on a first end of the base plate;

a left hand support positioned on a second end of the base plate;

a right hand lever support positioned on a right hand portion of the base plate; and a left hand lever support positioned on a left hand portion of the base plate;

the at least one torsion bar comprises at least one right hand torsion bar positioned between the right hand support and the right hand lever support and at least one left hand torsion bar positioned between the left hand support and the left hand lever support; and the lever positioned between the right hand lever support and the left hand lever support.

3. The resistance unit of claim 2 further comprising:

a lever shaft rotatably connected to the right hand lever support and the left hand lever support and rigidly coupled to the lever;

a plurality of actuators;

the at least one right hand torsion bar is coupled to an actuator of the plurality of actuators having a lock position and an unlock position configured to selectively rotatably lock the at least one right hand torsion bar to the right hand support and to the lever shaft in the lock position; and the at least one left hand torsion bar is coupled to an actuator of the plurality of actuators having a lock position and an unlock position and is configured to selectively rotatably lock and the at least one left hand torsion bar to the left hand support and to the lever shaft in the lock position.

4. The resistance unit of claim 3, wherein the rotational resistance is produced when any of the of the plurality of actuators of the at least one torsion bar is in the lock position when the force is applied to the lever.

5. The resistance unit of claim 3, further comprising:

a right hand driving gear coupled to a right hand end of the lever shaft;

a left hand driving gear coupled to a left hand end of the lever shaft and a driven gear coupled to each of the at least one right hand torsion bar and in meshing arrangement with the right hand driving gear; and a driven gear coupled to each of the at least one left hand torsion bar and in meshing arrangement with the left hand driving gear.

6. The resistance unit of claim 5, wherein the actuator of the at least one right hand torsion bar is coupled to the driven gear and the actuator of the at least one left hand torsion bar is coupled the driven gear.

7. The resistance unit of claim 5, wherein the actuator coupled to the at least one right hand torsion bar and is positioned in any of the right hand support and the left hand lever support and the actuator coupled to the at least one left hand torsion bar is positioned in any of the left hand support and the left hand lever support.

8. The resistance unit of claim 5, any of the at least one right hand torsion bar and the at least one left hand torsion bar are configured to produce a different torsional resistance.

9. The resistance unit of claim 5, further comprising at least one strain measurement device configured to measure a total resistance load and a sensor to measure a translation distance of the lever.

10. The resistance unit of claim 9 further comprising:

a user interface having an output screen coupled to the plurality of actuators and configured to:

allow a user to selectively position any of the plurality of actuators in the lock position; and output the total resistance load and the translation distance on the output screen.

11. The resistance unit of claim 1, wherein the at least one torsion bar comprises a torsion bar assembly comprising:

a lever shaft comprised of an elongated tube having a set of engagement holes distributed along a length and coupled to the lever;

the torsion bar having a complementary set of respective engagement holes and rigidly positioned in the frame at a first end and rotatably positioned in the frame at a second end positioned at least partially within the lever shaft; and an actuation pin configured to selectively couple the lever shaft and the torsion bar when engaged in one of the set of engagement holes and the complementary set of respective engagement holes.

12. A resistance training machine comprising:

a resistance training unit having at least one moveable member;

a variable resistance unit comprising:

a frame;

a lever rotatably coupled to the frame;

a plurality of torsion bars selectively rotatably mounted to the frame and to the lever; and the at least one moveable member coupled to the lever.

13. The resistance training machine of claim 12, further comprising:

a plurality of actuator assemblies having a lock position and an unlock position; wherein one of the plurality of actuator assemblies is coupled to each of the plurality of torsion bars and configured to selectively rotatably lock the plurality of torsion bars to the frame and to the lever in the lock position;

wherein the plurality of torsion bars are adapted to apply a rotational resistance load to the lever when at least one of the plurality of actuator assemblies is in the lock position and when a force is applied to the lever; and wherein the rotational resistance load is based on which of the plurality of torsion bars are rotatably locked and the force applied to the lever.

14. The resistance training machine of claim 13, wherein the at least one moveable member is configured to apply a force against the rotational resistance load when a force is applied to the at least one moveable member by a user.

15. The resistance training machine of claim 13, wherein the at least one moveable member has a translation distance and wherein the translation distance is based on which of the plurality of torsion bars are rotatably locked and the force applied to the lever.

16. The resistance training machine of claim 13, wherein any of the plurality of torsion bars are configured to produce a different torsional resistance.

17. The resistance training machine of claim 13, further comprising at least one strain measurement device configured to measure a total resistance load and a sensor to measure a translation distance of the moveable member.

18. The resistance training machine of claim 17, further comprising:

a user interface having an output screen coupled to the plurality of actuator assemblies and configured to:

allow a user to selectively position any of the plurality of actuator assemblies in the lock position; and output a total resistance load and the translation distance on the output screen.

19. The resistance training machine of claim 18, further comprising the user interface configured to allow a user to selectively position any of the plurality of actuator assemblies in the unlock position.

20. The resistance training machine of claim 12, wherein the moveable member is coupled to the lever by a system comprised of a cable and a plurality of pulleys.

* * * * *